US006286700B1

(12) United States Patent
Davidson

(10) Patent No.: US 6,286,700 B1
(45) Date of Patent: Sep. 11, 2001

(54) PACKAGING HAVING A FLEXIBLE INNER BAG AND A RIGID OUTER CASING

(75) Inventor: Paul Davidson, Macclesfield (GB)

(73) Assignee: Bag in a Box Limited, Manchester (GB)

( * ) Notice: Subject to any disclaimer, the term of this patent is extended or adjusted under 35 U.S.C. 154(b) by 0 days.

(21) Appl. No.: 09/463,025

(22) PCT Filed: Jul. 17, 1998

(86) PCT No.: PCT/GB98/01924

§ 371 Date: Mar. 20, 2000

§ 102(e) Date: Mar. 20, 2000

(87) PCT Pub. No.: WO99/03752

PCT Pub. Date: Jan. 28, 1999

(30) Foreign Application Priority Data

Jul. 17, 1997 (GB) ..... 9714996

(51) Int. Cl.[7] ..... B65D 25/16
(52) U.S. Cl. ..... 220/1.6; 220/495.06
(58) Field of Search ..... 220/495.06, 495.01, 220/1.6; 222/94

(56) References Cited

U.S. PATENT DOCUMENTS

| | | | | |
|---|---|---|---|---|
| 4,960,227 | * | 10/1990 | Coleman | 222/94 |
| 5,005,726 | * | 4/1991 | Robbins | 220/403 |
| 5,050,775 | | 9/1991 | Marquardt | 222/93 |
| 5,069,359 | | 12/1991 | Liebel | 220/441 |
| 5,154,307 | * | 10/1992 | Hauk | 220/403 |
| 5,897,012 | * | 4/1999 | Sortwell | 220/4.28 |
| 5,979,685 | * | 11/1999 | Schutz | 220/1.6 |

FOREIGN PATENT DOCUMENTS

| | | | |
|---|---|---|---|
| 2 172 663 A | 9/1986 | (GB) | B67D/1/04 |
| WO 92/16432 | 10/1992 | (WO) | B65D/77/06 |

* cited by examiner

*Primary Examiner*—Stephen Castellano
(74) *Attorney, Agent, or Firm*—Myers Bigel Sibley & Sajovec, P.A.

(57) ABSTRACT

A container for transporting material, comprises an outer container having first and second container openings therein, and a container liner having first and second liner openings therein. The first liner opening is sufficiently small to be passed through the second container opening and is adapted for connection to the first container opening. The second liner opening is adapted for attachment to the second container opening.

18 Claims, 5 Drawing Sheets

PACKAGING HAVING A FLEXIBLE INNER BAG AND A RIGID OUTER CASING

This invention relates to containers and in particular to containers for carrying fluids/pourable goods such as liquids and pourable powders, and also methods of assembling such containers.

So-called intermediate bulk containers may include a rigid outer box like-structure made of, for instance plastics material. They are generally only suitable for carrying a single commodity due to the difficulty in cleaning their interiors so that a different material may be transported. Accordingly, such containers typically are used to transport materials from one destination to another and then are returned empty.

GB-A-2172663 discloses a liquid container comprising an inner flexible bag and an outer relatively rigid casing. The inner bag and the casing both have first connected together openings and second connected together openings, the inner bag being filled via the first openings and emptied via the second openings.

There is a need for a container which may be used for different materials and/or used repeatedly for the same material and which is hygienic in the sense that the material which is transported on a particular journey can not contaminate material, whether the same or different, transported in a different journey.

According to a first aspect of the present invention there is provided a container for the transport of material comprising an outer container having first and second container openings therein, and a container liner having first and second liner openings therein, said first liner opening being sufficiently small to be passed through said second container opening and being adapted for connection to said first container opening and said second liner opening being adapted for attachment to said second container opening.

Preferably, said outer container is rigid and ideally is constructed of plastics, even more ideally the container has a volumetric capacity in the region of 1 cubic meter. Further support may optionally be provided by means of an external metal cage.

Preferably, the outer container first opening is located at an upper region of said container, ideally in a top surface thereof and ideally is associated with a cap member. More preferably the second opening is located in a side-wall, and ideally is located adjacent the base of said container.

Preferably, the second opening is shaped so as to provide a stepped region with which a port member can engage. Additionally associated with said second opening there is provided a valve means for controlling the voiding of the liner contents.

Preferably, said liner is constructed of flexible materials such as plastics sheeting and is in the form of a bag. Ideally, each of said first and said second liner openings are associated with rigid port members, the dimensions of the port members being such that they may be passed through the openings of the outer container.

Preferably, each port member comprises a relatively short tube which is welded at one end to an integral flange of a main body of the liner and is provided with a groove at an opposite end. Ideally at least one of said port members is provided with a hygienic seal in the form of a thin membrane. Even more ideally, associated with said port member there is provided an attachment means for attaching a rope/string/thread/cord thereto. Said attachment means comprising a split ring located within the groove of the port member.

Ideally the container and/or liner is/are reusable.

According to a second aspect of the invention, there is provided a method of assembling a container as hereinbefore described comprising:

(i) attaching a rope/string/thread/cord to the liner opening;

(ii) placing the liner in the outer container and drawing the rope/string/thread/cord out of the second opening of the outer container so as to expose said liner opening;

(iii) locating a split ring in a groove located in said liner opening;

(iv) pushing said liner opening back towards the interior of the outer container so as to engage said liner opening in said second outer container opening; and (v) attaching a valve to said liner opening and filling the liner with pourable goods.

An embodiment of the present invention will now be described, by way of example only, and with reference to the accompanying drawings in which:

FIGS. 6 to 11 shows aspects of the connection of the other of the container openings to the other of the liner openings.

Figure 1:
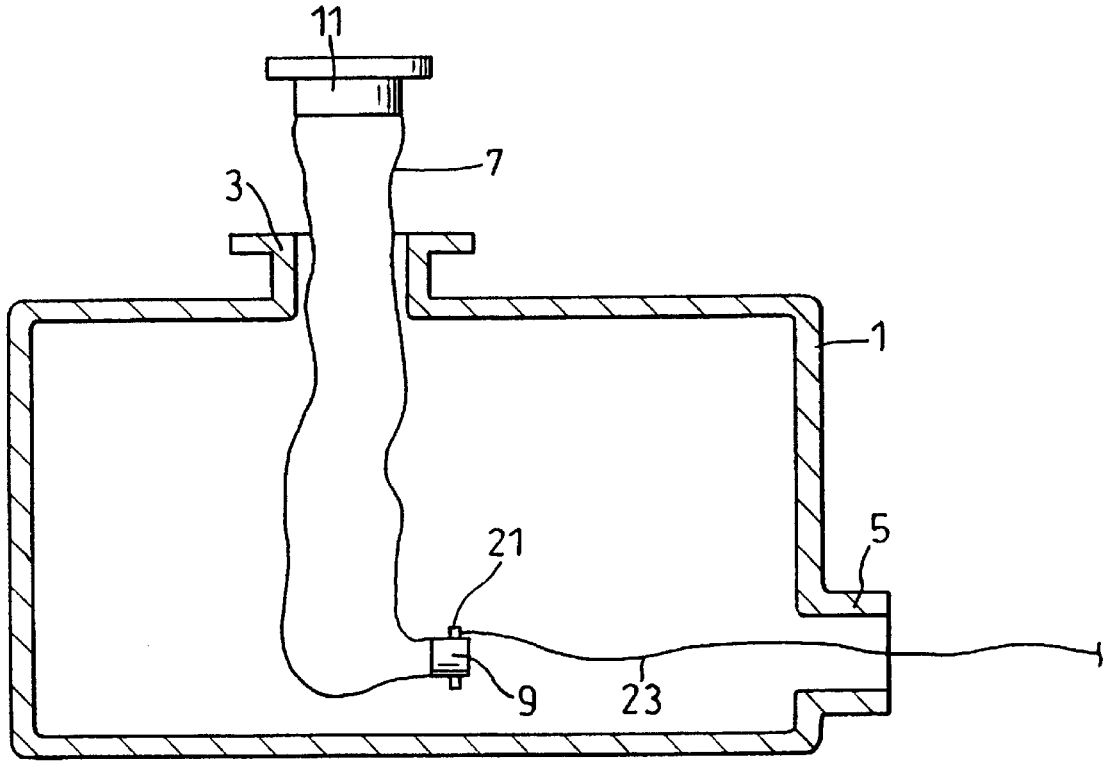
FIG. 1 shows the insertion of a liner into a container.

Referring to the accompanying drawings, a container for the transport of material in accordance with the present invention comprises a rigid outer container 1 which is made of plastics material and has a volume of one cubic metre. It may further be provided with an external metal cage structure (not shown) to give support to the container. Container 1 is provided with two openings or ports, upper port 3 located in the top of the container and lower port 5 located in a side wall adjacent the base of the container.

Container 1 is provided with a liner 7 which may be made of flexible plastics sheet material. Liner 7 is in the form of a bag having two openings or ports 9, 11 therein. Each opening 9, 11 is defined by a rigid port member in the form of a tube as will be described in greater detail below. The port member defining opening 9 is of dimensions such that it may be passed through the opening 3 of the outer container 1.

Figure 2:
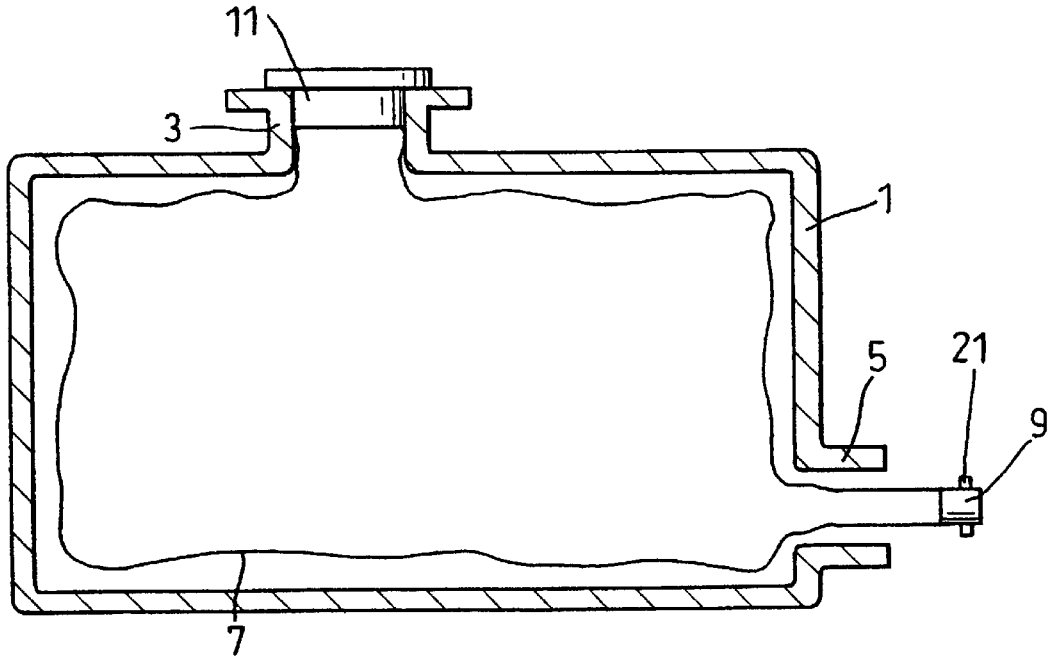
FIG. 2 shows the container after insertion of the liner.
Figure 3:
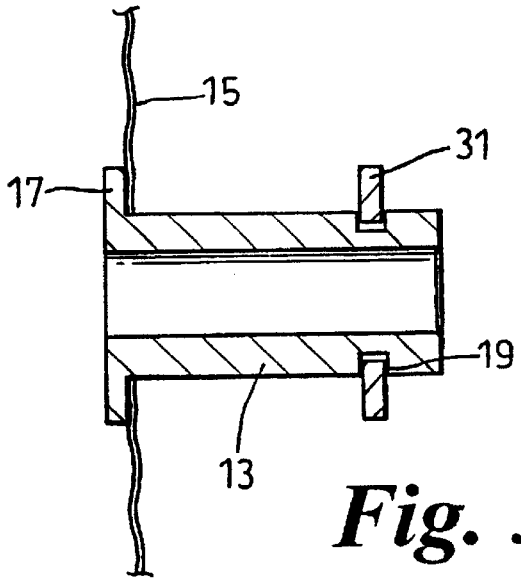
FIGS. 3 to 7 show aspects of the connection of one of the container openings to one of the liner openings.

Referring to FIG. 3, there is illustrated port member 13 which defines opening 9 of liner 7. Port member 13 is in the form of a short tube which is welded to the body 15 of the liner 7 at integral flange 17 located at one end of tube 13. Close to the other end of tube 13 is an outer peripheral groove 19. As a first step in the loading of liner 7 into container 1, a ring 21, to which is attached a rope or string 23, is attached to port member 13 by means of groove 19. String 23 is then lowered into the container through opening 3 and pulled out of container 1 through opening 5, pulling behind it the liner 7. This operation is continued until the position shown in FIG. 2 is reached with opening 9 of container 7 pulled through opening 5 and with opening 11 of liner 7 abutting opening 3 of container 1.

Figure 4:
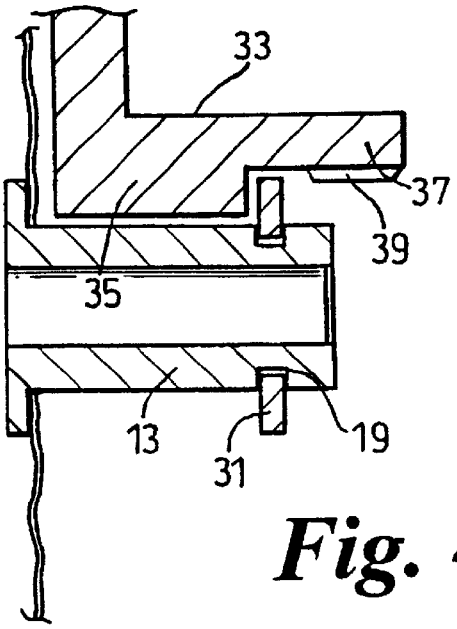

The next stage is the connection together of opening 9 of liner 7 and opening 5 of container 1. The sequence of operations to achieve this is shown in FIGS. 3 to 7. The first step is to locate a split ring 31 in groove 19 of port member 13 (see FIG. 3). FIG. 4 illustrates the shape of opening 5 of container 1. This opening includes an outwardly extending tube portion 33 having an inner stepped surface providing an inner region 35 of relatively narrow diameter and an outer region 37 of greater diameter. Outer region 37 is provided with an internal screw thread 39. With split ring 31 in position in groove 19, port member 13 of liner 7 may be pushed back into container 1 until split ring 31 engages with the step between regions 35 and 37 of tube portion 33 (see FIG. 4).

Figure 5:
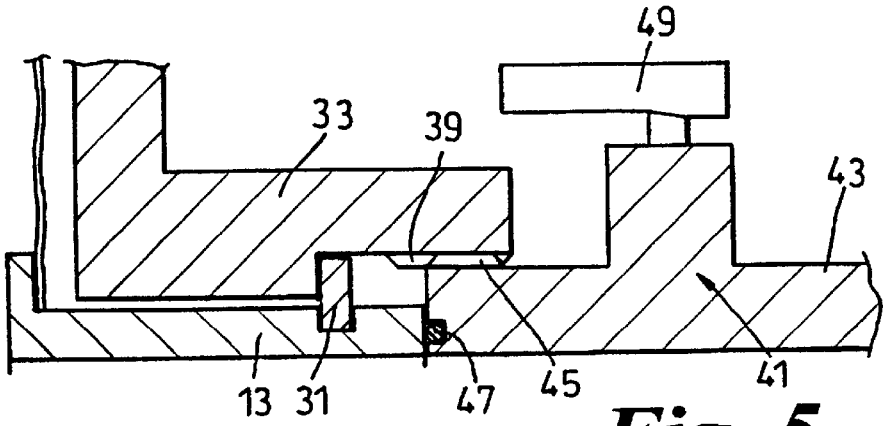
Figure 6:
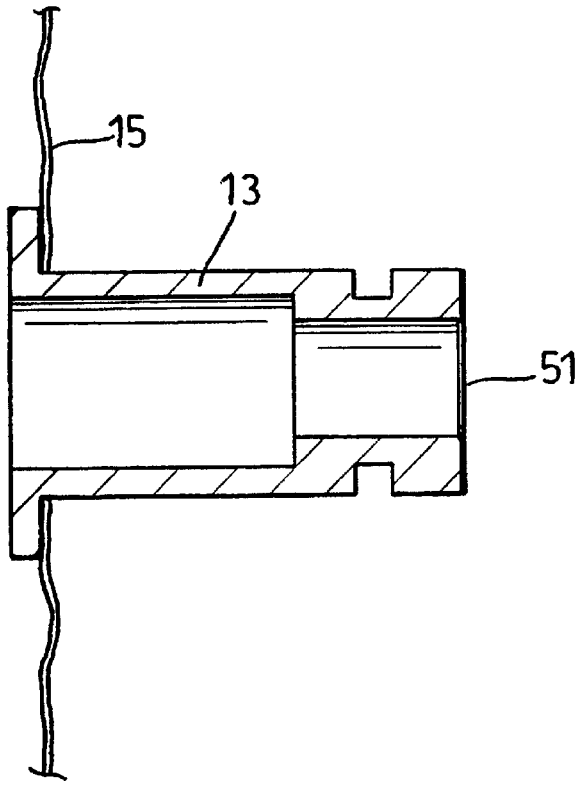
Figure 7:
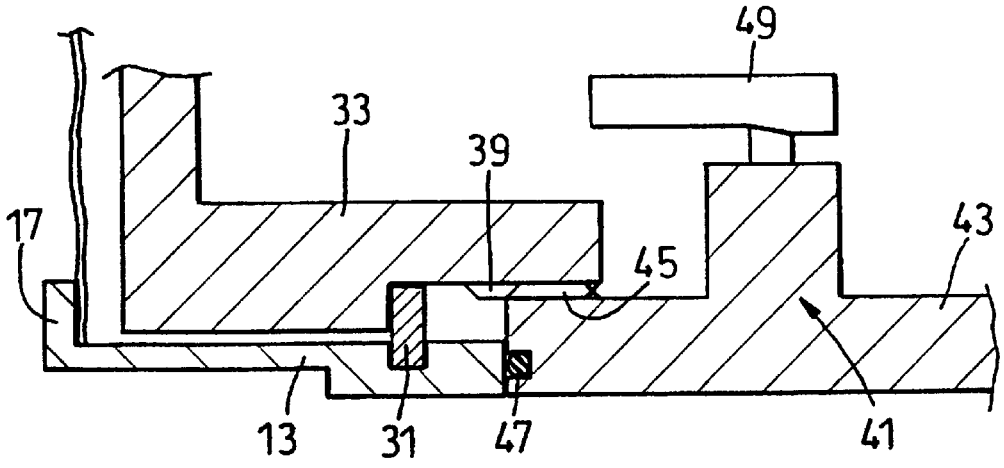

Referring to FIG. 5, the next step is to attach ball valve member 41 to opening 5 of container 1. As best illustrated in FIG. 7, ball valve member 41 includes a housing 43 having a broadly tubular shape with an outer diameter corresponding to the internal diameter of region 37 of tube portion 33. Housing 43 is provided with a threaded portion 45 for engagement with the corresponding threaded portion 39 of tube portion 33. Housing 43 is also provided with an O ring 47 located in a groove at the end of the housing adjacent threaded portion 45, O ring 47 being for sealing engagement against the outer edge of port member 13. Ball valve 41 carries an external handle 49 for operating the opening and closing of the ball valve. As illustrated in FIG. 6, port member 13 of liner 7 is closed at its free end by thin plastics film 51, ensuring that the inside of the liner is kept hygienically clean. Film 51 may be broken to place the interior of the liner in fluid communication with ball valve 41.

Figure 8:
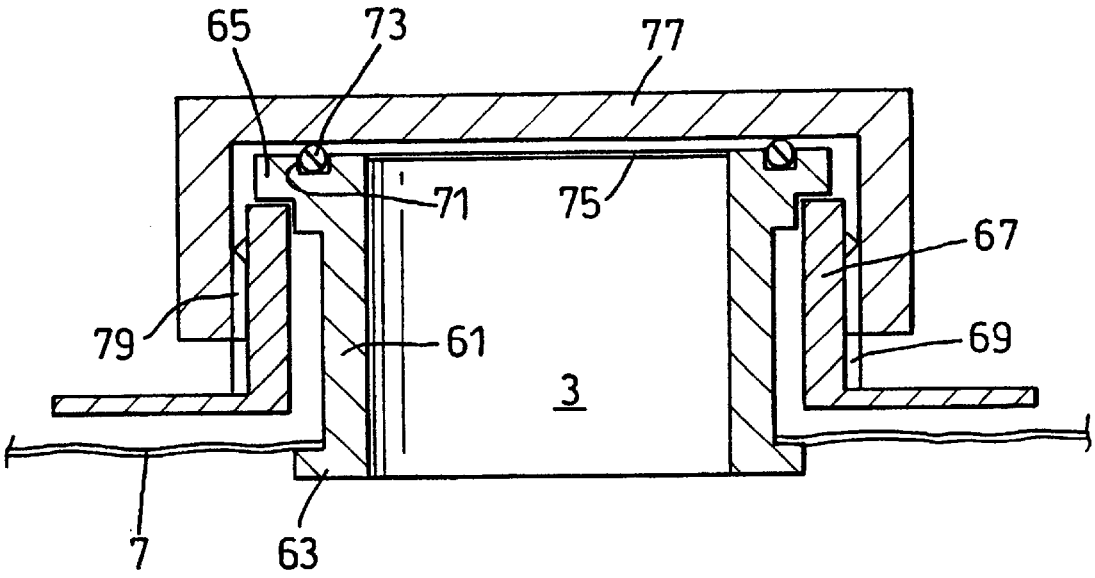
Figure 9:
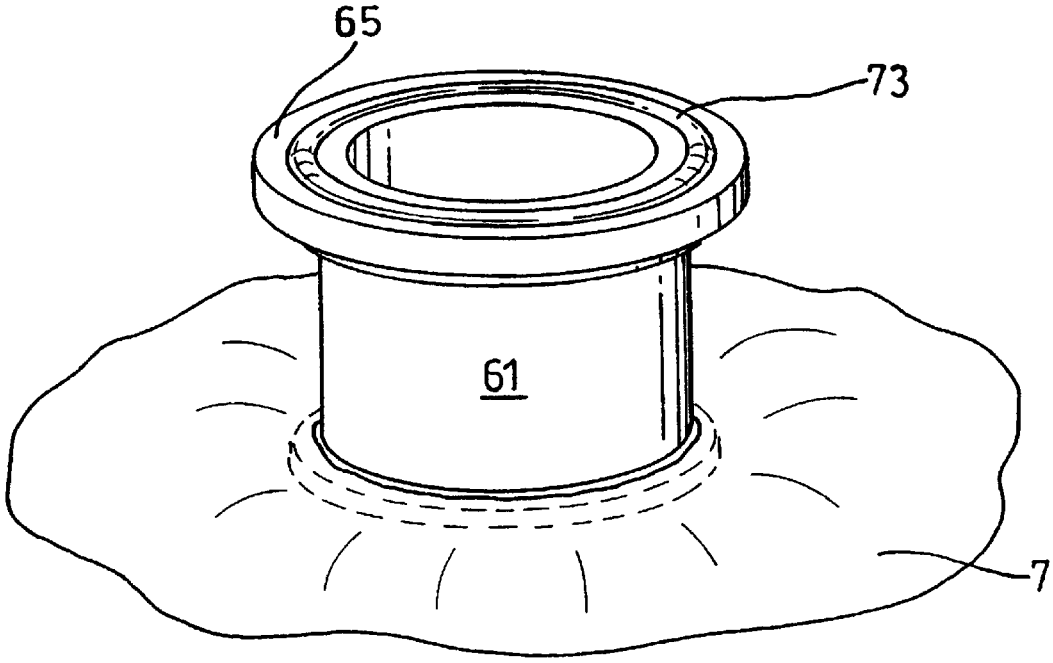
Figure 10:
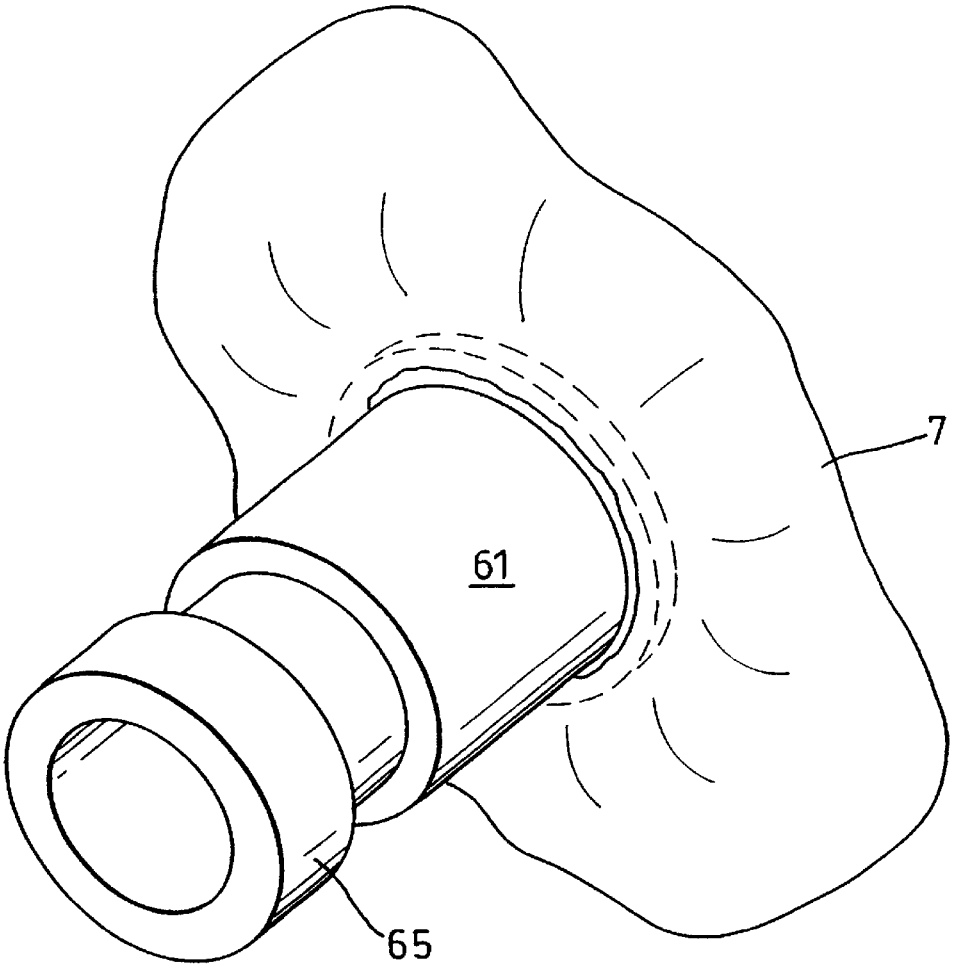
Figure 11:
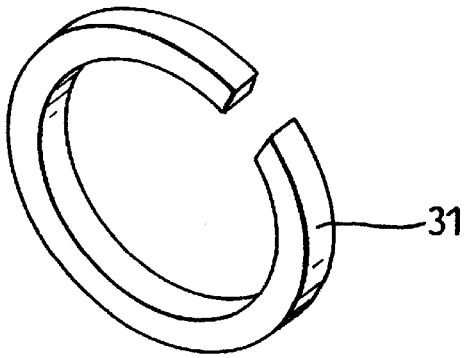

Referring now to FIGS. 8 to 11, there is illustrated the attachment of the other opening 11 of the liner 7 to the other opening 3 of container 1. Liner 7 includes a rigid port member 61 in the form of a short tube which is welded to liner 7 at its flanged inner end 63. The other end of port member 61 is provided with a larger flange 65. As illustrated in FIG. 8, opening 3 of container 1 is in the form of an outwardly extending tube portion 67 having an external threaded portion 69. Flange 65 of port member 61 is such that, when port member 61 is lowered into container 1, this flange sits on the outer radial surface of tube portion 67 of container 1. At its outer free end, member 61 is provided with a peripheral groove 71 in which is located an O ring 73. The opening in liner 7 is initially closed by an integral thin plastics film 75 which may be broken to allow material to be loaded into the container. When this has been achieved, a cap 77, having an internal screw thread 79, corresponding to external thread 69 of container opening 3, is located in position to close the container at this opening.

It has been found that the whole operation of inserting a liner into a container, and securing the liner to the container at the two openings, may take as little as 45 seconds. Once the container has been emptied of the material carried by it, the lining may be removed by reversing the above described procedure and a new liner inserted.

What is claimed is:

1. A container for the transport of material comprising an outer container having first and second container openings therein, and a container liner having first and second liner openings therein, said first liner opening being adapted for connection to said first container opening and said second liner opening being adapted for attachment to said second container opening, said first liner opening being sufficiently small to be passed through said second container opening, said first liner opening including a tubular, rigid port member having the container liner attached to one end and being provided with an external peripheral groove adjacent the other end, said first liner opening further including a split ring positioned within said peripheral groove to prevent relative movement of said port member into the interior of the outer container.

2. A container according to claim 1 wherein said outer container is rigid and is constructed of plastics.

3. A container according to claim 1, wherein the container has a volumetric capacity in the region of 1 meter.

4. A container according to claim 1, further comprising an external metal cage.

5. A container according to claim 1 wherein the outer container first opening is located at an upper region of said container.

6. A container according to claim 5 wherein the first opening is located in a top surface of said outer container.

7. A container according to claim 1 further comprising a cap member for sealing said first opening of said outer container.

8. A container according to claim 1 wherein the second opening of said container is located in a side-wall.

9. A container according to claim 1 wherein the second opening of said container is located adjacent the base of said container.

10. A container according to claim 1 wherein the second opening is shaped so as to provide a stepped region with which the port member can engage.

11. A container according to claim 1 wherein the first opening is provided with valve means for controlling the voiding of the liner contents.

12. A container according to claim 1 wherein said liner is constructed of flexible materials such as plastics sheeting and is in the form of a bag.

13. A container according to claim 1 wherein said second liner opening is provided with a rigid port member, the dimensions of the port member being such that it may be passed through the second opening of the outer container.

14. A container according to claim 13 wherein said port member of said second liner opening comprises a relatively short tube having an integral flange welded to a main body of the liner, the tube being provided with a groove at an opposite end.

15. A container according to claim 13 wherein said port member of said second liner opening is provided with a hygienic seal in the form of a thin membrane covering the port opening.

16. A container according to claim 13 wherein said port member associated with said first liner opening is provided with an attachment means for attaching a rope/string/thread/cord thereto.

17. A container according to claim 16 wherein said attachment means comprises a split ring located within the groove of the port member.

18. A container according to claim 1 wherein the container and/or liner is/are reusable.

* * * * *